United States Patent [19]

Noda et al.

[11] Patent Number: 4,933,604

[45] Date of Patent: Jun. 12, 1990

[54] PLATE-TYPE CATHODE RAY TUBE DEVICE

[75] Inventors: Fumio Noda, Chiba; Masakazu Fukushima, Tokyo, both of Japan

[73] Assignee: Hitachi, Ltd., Tokyo, Japan

[21] Appl. No.: 151,966

[22] Filed: Feb. 3, 1988

[30] Foreign Application Priority Data

Feb. 6, 1987 [JP] Japan ..... 62-24532

[51] Int. Cl.[5] ..... G09G 3/10; G09G 3/30; H01J 29/70; H01J 1/62

[52] U.S. Cl. ..... 315/169.3; 313/422; 313/494; 313/496; 313/497; 340/781; 340/825.79

[58] Field of Search ..... 315/169.3, 169.4; 313/422, 413, 414, 416, 418, 420, 421, 494, 496, 497, 169.3, 169.4; 340/781, 825.79; 358/230

[56] References Cited

U.S. PATENT DOCUMENTS 4,622,492 11/1986 Barten ..... 313/422
4,694,225 9/1987 Tomii et al. ..... 313/422

FOREIGN PATENT DOCUMENTS 271926 6/1988 European Pat. Off. ..... 313/422
0002619 10/1971 Japan .
0189849 9/1985 Japan .
0193242 10/1985 Japan ..... 313/413

*Primary Examiner*—Eugene R. LaRoche
*Assistant Examiner*—Michael B. Shingleton
*Attorney, Agent, or Firm*—Antonelli, Terry, Stout & Kraus

[57] ABSTRACT

A plate-type cathode ray tube device is disclosed in which a plurality of electron beams are emitted in directions parallel to a fluorescent screen, each of the electron beams is so deflected as to be perpendicular to the fluorescent screen, and performs a scanning operation in a direction parallel to the initial direction of the electron beam, a deflection voltage for deflecting each electron beam and for causing each electron beam to perform the above scanning operation is applied to one of a plurality of deflection plates which is juxtaposed in a direction parallel to the initial direction of the electron beam and each of which extends in a direction perpendicular to the initial direction of the electron beam, in such a manner that the deflection plates are successively applied with the deflection voltage, and a focusing correction voltage for keeping the size of electron beam spot formed on the fluorescent screen constant all over the fluorescent screen is applied to one of the deflection plates at the same time the deflection voltage is applied to a different one of the deflection plates.

18 Claims, 17 Drawing Sheets

PLATE-TYPE CATHODE RAY TUBE DEVICE

BACKGROUND OF THE INVENTION

The present invention relates to a cathode ray tube used in a color television receiver or a terminal display of a computer, and more particularly to a plate-type cathode ray tube device.

For example, a first one of conventional plate-type cathode ray tube devices is disclosed in a Japanese Patent Publication JP-A-46-2619, and a second conventional plate-type cathode ray tube device is disclosed in a Japanese Patent Publication JP-A-60-189,849.

The structure of the first conventional device will be explained below, with reference to FIG. 16. Referring to FIG. 16, a fluorescent screen 2 is formed on the inner surface of a face plate 1 of a vacuum vessel (not shown), and a plurality of deflection electrodes 41 each extended in a horizontal direction are formed on a back panel 3 which is provided in parallel to the fluorescent screen 2. In more detail, the deflection electrodes 41 are juxtaposed at regular intervals in a vertical direction. Further, a plurality of electron guns are provided at the bottom of a spatial region sandwiched between the fluorescent screen 2 and the deflection electrodes 41, in such a manner that the electron guns are arranged at regular intervals in a horizontal direction. The electron guns are made up of an electron source 71 and two control electrode plates 82 and 83. That is, thermal electrons emitted from the electron source 71 pass through apertures which are provided in each of the control electrode plates 82 and 83, to form a plurality of electron beams 10 which are intensity-modulated independently of each other. Further, the first to n-th deflection electrodes 41 viewed from the electron gun side are applied with a voltage equal to a voltage applied to the fluorescent screen 2, and the (n+1)th and following deflection electrodes 41 are applied with a voltage lower than the voltage applied to the fluorescent screen 2. Thus, the electron beams 10 emitted from the electron guns run straight till the electron beams reach the vicinity of the n-th deflection electrode 41, and are then deflected toward the fluorescent screen 2 by a repulsive force from the (n+1)th and following deflection electrodes 41. As a result, those portions of the fluorescent screen 2 which are bombarded with the electron beams 10 emit light in accordance with the modulated intensities of the electron beams, and thus a scanning line is formed on the screen 2. By sequentially changing the n-th deflection electrode 41 by changing the numerical value n, the fluorescent screen 2 can be scanned with each electron beam 10 in a vertical direction because the n-th deflection electrode 41 is applied with the same voltage as the voltage which is applied to the fluorescent screen 2 from an external power supply.

In the second conventional device, as shown in FIG. 17, a single vertical deflection electrode 42 (that is, a single plane electrode) is formed on the back panel 3, in place of plural deflection electrodes 41 of FIG. 16. Further, a plurality of plane electrodes 52, 53, 54, each having an aperture 55 which is extended in a vertical direction and corresponds to one of a plurality of electron beams 10, and a plurality of horizontal deflection electrodes 62, each extended in a vertical direction, are disposed between the vertical deflection electrode 42 and the fluorescent screen 2. In more detail, a pair of horizontal deflection electrodes 62 are provided for each of the electron beams 10, to deflect the electron beam in a horizontal direction. Further, an auxiliary deflector 87 is provided between the electron guns and the vertical deflection electrode 42. Thus, the electron beam emitted from an electron gun is deflected by the auxiliary deflector 87 in a direction perpendicular to the fluorescent screen 2, and is then deflected toward the fluorescent screen 2 by a repulsive force from the vertical deflection electrode 42. Thus, in a case where the electron beam is deflected by the auxiliary deflector 87 so as to go near the vertical deflection electrode 42, the electron beam impinges on the fluorescent screen 2 at a position far from the electron gun. While, in a case where the electron beam is deflected by the auxiliary deflector 87 so as to go away from the vertical deflection electrode 42, the electron beam impinges on the fluorescent screen 2 at a position near the electron gun. Hence, the fluorescent screen 2 can be scanned with the electron beam 10 in a vertical direction, by controlling the deflecting direction given by the auxiliary deflector 87. Each of the electron beams 10 deflected toward the fluorescent screen 2 is subjected to the focusing action in a horizontal direction by one of the plane electrodes 52, 53, 54 and then deflected in a horizontal direction by a pair of horizontal deflection electrodes 62, to impinge on the fluorescent screen 2. Thus, the electron beams 10 form a plurality of electron beam spots on the fluorescent screen 2. When each electron beam 10 is deflected in a horizontal direction by an amount corresponding to the distance between adjacent electron guns, one scanning line can be formed on the fluorescent screen 2 by bright lines each scanned with one electron beam.

In the first and second conventional devices, there arises a problem that it is impossible to make the shape of electron beam spot constant all over the fluorescent screen. Further, the first conventional device is not provided with horizontal scanning means, and hence cannot obtain a satisfactory resolution in a horizontal direction. In order to improve the resolution in a horizontal direction, it is necessary to increase the number of electron beams, and thus the device becomes large in scale. In order to perform a vertical scanning operation, the first conventional device is required to include deflection electrodes, the number of which is not less than the number of scanning lines. Hence, it is very difficult to control many electron beams uniformly. Further, in order to drive many deflection electrodes with low power consumption, the first conventional device is required to have a complicated construction. In the first conventional device, the electron beam is subjected to the focusing action in a horizontal direction only by the electron gun, and thus it is impossible to keep the shape of electron beam spot optimum all over the fluorescent screen.

In the second conventional device, the influence of the vertical deflection electrode on an electron beam varies greatly with the deflecting direction given by the auxiliary deflector. As a result, the focused state of the electron beam at the top of the fluorescent screen is greatly different from that of the electron beam at the bottom of the fluorescent screen. Unlike the first conventional device, the second conventional device is provided with horizontal scanning means, and hence can obtain a satisfactory horizontal resolution by using a relatively small number of electron beams. However, the second conventional device is provided with a plurality of plane electrodes each for the focusing action in a horizontal direction, in addition to the horizontal deflection electrodes, and hence is obliged to become complicated in structure and large in scale.

SUMMARY OF THE INVENTION

It is an object of the present invention to provide a plate-type cathode ray tube device which can solve the above problems of the conventional devices and can obtain an optimum electron beam spot at the whole area of a fluorescent screen.

In order to attain the above object, according to the present invention, there is provided a plate-type cathode ray tube device which comprises: deflection means for deflecting an electron beam emitted in a direction substantially parallel to a fluorescent screen, toward the fluorescent screen and for causing the electron beam to perform a scanning operation in a direction parallel to a direction in which the electron beam is emitted, the deflection means being made up of a plurality of plane electrodes juxtaposed in a direction parallel to the direction in which the electron beam is emitted; and means for applying a voltage to at least two adjacent ones of the plane electrodes, the voltage being able to keep the focusing action on the electron beam in a scanning direction, constant when the electron beam is deflected to perform the scanning operation.

In the plate-type cathode ray tube device according to the present invention, an electron beam emitted in a direction substantially parallel to the fluorescent screen runs straight in a spatial region formed between the deflection means and the fluorescent screen, and is then deflected toward the fluorescent screen in the vicinity of two plane electrodes applied with predetermined voltages. Further, a voltage applied to each of the two plane electrodes is controlled so that the electron beam performs a scanning operation in a direction parallel to a direction in which the electron beam is emitted, and is subjected to constant focusing action during the scanning period. Thus, an optimum electron beam spot can be formed at the whole area of the fluorescent screen.

DESCRIPTION OF THE PREFERRED EMBODIMENTS

Figure 1:
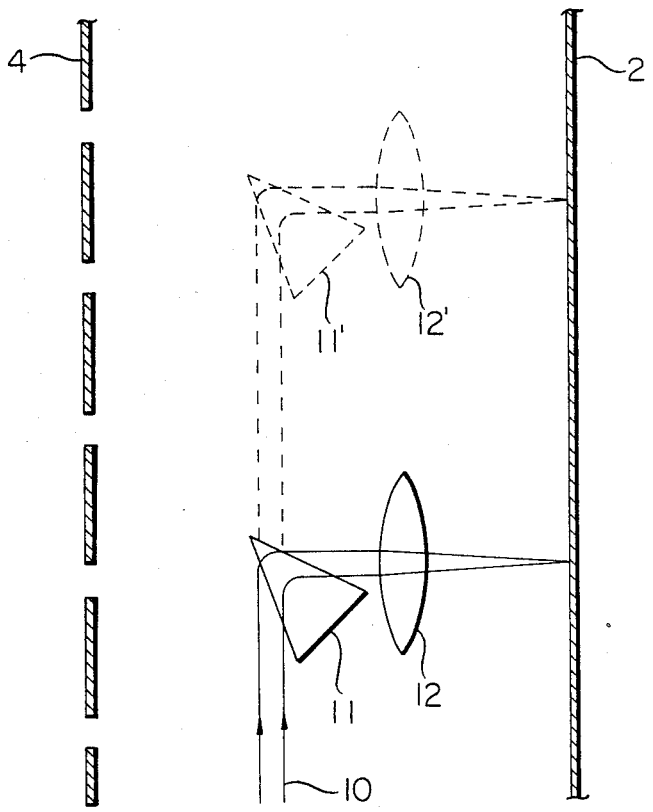
FIGS. 1, 2A and 2B are schematic digrams for explaining an operation principle of a plate-type cathode ray tube device according to the present invention.

At first, the operation principle of a plate-type cathode ray tube device according to the present invention will be explained, with reference to FIGS. 1, 2A and 2B. FIG. 1 shows the operation principle of an example of means used in a plate-type cathode ray tube device according to the present invention for scanning a fluorescent screen with an electron beam in a first direction. It is to be noted that means for scanning the fluorescent screen with the electron beam in a second direction is omitted from FIG. 1 for the sake of simplicity, and only an equivalent deflecting optical system 11 and an equivalent focusing optical system 12 are shown in FIG. 1. Referring to FIG. 1, an electron beam 10 emitted from an electron gun (not shown) first runs straight in a spatial region formed between deflection plates 4 and a fluorescent screen 2, and is then deflected toward the fluorescent screen 2 by a repulsive force from a deflection plate applied with a specified deflection voltage. In the above operation, for example, two adjacent deflection plates are applied with different deflection voltages, to deflect the electron beam toward the fluorescent screen 2 and to focus the electron beam on the fluorescent screen in a first direction. Further, by varying the deflection voltages periodically, that area of the fluorescent screen which corresponds to the length of one deflection plate in the first direction, can be scanned with the electron beam. When all the deflection plates 4 are successively applied with each of the deflection voltages, the whole area of the fluorescent screen in the first direction is scanned with the electron beam, and moreover the electron beam can be focused on the fluorescent screen at different positions as indicated by solid lines and broken lines in FIG. 1.

Figure 2A:
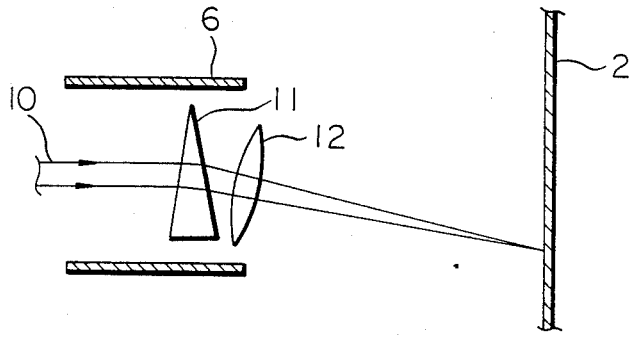
Figure 2B:
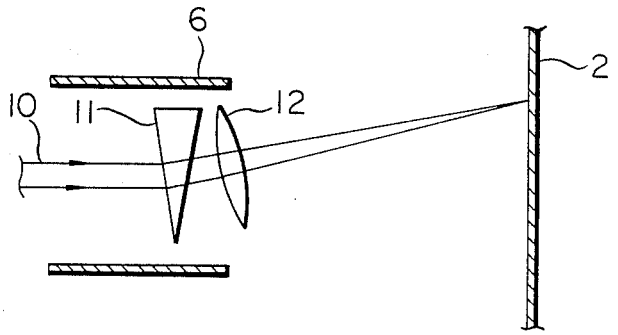

FIGS. 2A and 2B show the operation principle of means used in a plate-type cathode ray tube device according to the present invention for scanning a fluorescent screen in a second direction. Referring to FIGS. 2A and 2B, the electron beam 10 which has been deflected toward the fluorescent screen 2 in a manner explained with reference to FIG. 1, is deflected in a second direction by a pair of strip-shaped deflection electrodes 6, and then impinges on the fluorescent screen 2. In the above operation, the deflection electrodes 6 are applied with different deflection voltages, to deflect the electron beam in the second direction and to focus the electron beam on the fluorescent screen in the second direction. Thus, even when the electron beam is deflected in opposite directions as shown in FIGS. 2A and 2B, the electron beam is focused on the fluorescent screen.

Now, explanation will be made of a first embodiment of a plate-type cathode ray tube device according to the present invention, with reference to the drawings.

Figure 3:
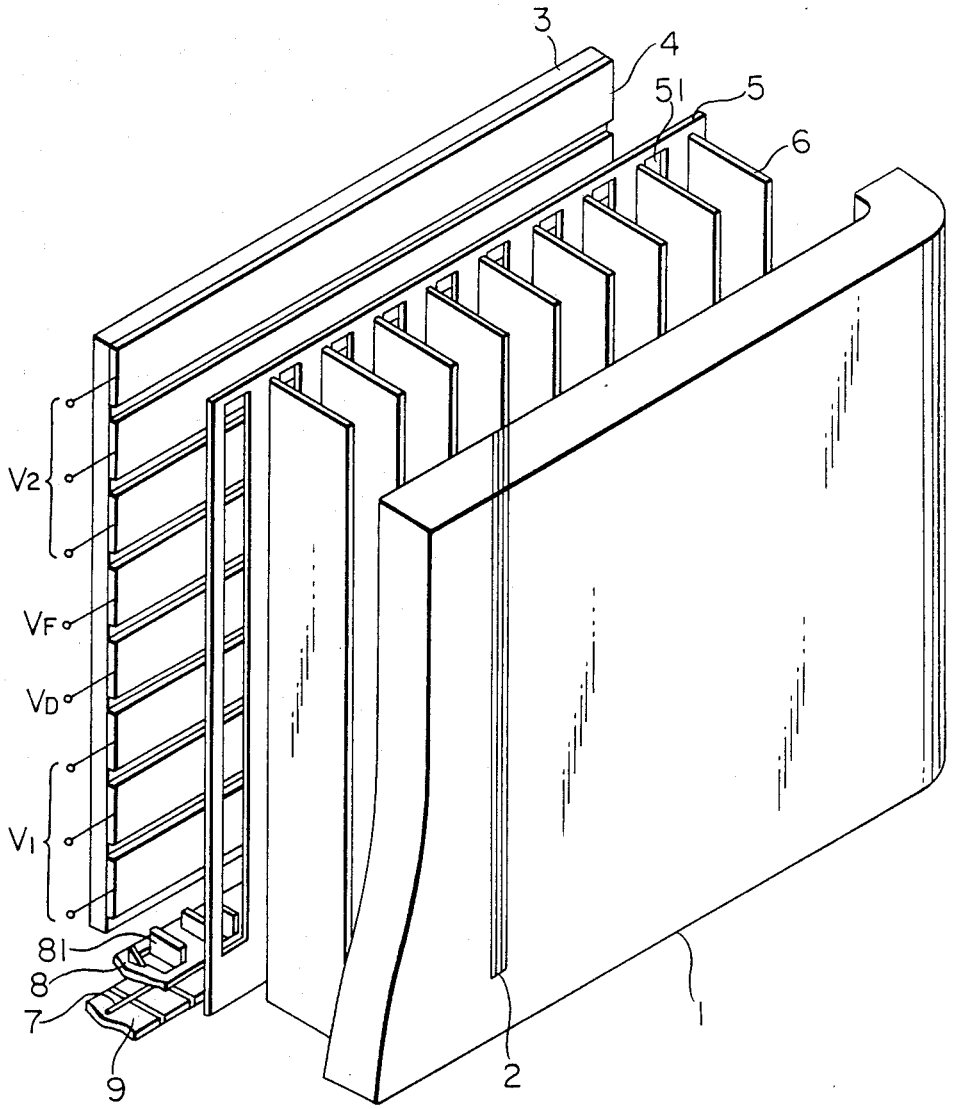
FIG. 3 is a partially cutaway view in perspective of a first embodiment of a plate-type cathode ray tube device according to the present invention.

FIG. 3 shows the outline of the inner structure of the first embodiment. Referring to FIG. 3, fluorescent materials for three primary colors (namely, red, green and blue) are applied to the inner surface of a face plate 1 of a vacuum vessel made of glass, in vertical directions so as to form a striped pattern. Thus, a fluorescent screen 2 is formed on the inner surface of the face plate 1. Further, a plurality of deflection plates 4 each extended in a horizontal direction are provided on the inner surface of a back panel 3 of the vacuum vessel so as to be juxtaposed at regular intervals in a vertical direction. The deflection plates 4 are electrically insulated from each other, and hence different voltages can be successively applied to each deflection plate independently of the remaining deflection plates.

In the above, the fluorescent screen 2 and the deflection plates 4 are formed on the face plate 1 and the back panel 3, respectively. Alternatively, the fluorescent screen 2 may be formed on another transparent substrate than the face plate 1, and the deflection plate 4 may be disposed independently of the back panel 3. A plane electrode 5 having a plurality of apertures 51 which are arranged at regular intervals in a horizontal direction and are extended in vertical directions, is disposed between the fluorescent screen 2 and the deflection plates 4 so that the plane electrode 5 is parallel to the deflection plates 4. Further, a plurality of strip-shaped deflection electrodes 6 each extended in a vertical direction are disposed between the fluorescent screen 2 and the plane electrode 5 in such a manner that each deflection electrode 6 intersects with the center line of that portion of the plane electrode 5 which exists between adjacent apertures 51, and the deflection electrodes 6 are parallel to each other. Alternate ones of the strip-shaped deflection electrodes 6 are electrically connected to each other, and thus adjacent ones of the deflection electrodes 6 are applied with different voltages. An electron gun is disposed at the bottom of a deflection region formed between the deflection plates 4 and the plane electrode 5, that is, at one end of the deflection region in a vertical direction. The electron gun is made up of a line cathode 7 which is extended in a horizontal direction, a control electrode 8 and a back electrode 9. Each of the control electrode 8 and the back electrode 9 is a long, narrow electrode extended in a horizontal direction. The line cathode 7 may be replaced by a plurality of cathodes each capable of emitting an electron beam.

The electron gun emits a plurality of electron beams which are arranged at regular intervals in a horizontal direction and correspond to the apertures 51 of the plane electrode 5, into the deflection region so that the electron beams are parallel to each other. Accordingly, the control electrode 8 has a plurality of apertures for transmitting the electron beams. The line cathode 7 is disposed between the control electrode 8 and the back electrode 9 so that the line cathode 7 is placed just under respective centers of the apertures of the control electrode 8. Further, the line cathode 7 is held by a mechanism for preventing the bending of the line cathode due to vibration or thermal expansion so that the line cathode is spaced apart from the back electrode 9 a predetermined distance. The back electrode 9 is electrically separated into parts in accordance with the apertures of the control electrode 8, and each part of the back electrode 9 is applied with an electric potential which is zero to tens of volts lower than the electric potential of a corresponding portion of the line cathode 7. In a case where the electric potential applied to one part of the back electrode 9 is too low, thermal electrons are not emitted from a corresponding portion of the line cathode 7, and thus the corresponding portion is put in a cut-off state. When the electric potential applied to one part of the back electrode 9 is made high, thermal electrons can be emitted from a corresponding portion of the line cathode 7. That is, the amount of emitted thermal electrons can be controlled by varying the applied electric potential. The emitted thermal electrons are taken out from one aperture of the control electrode 8 in the form of an electron beam, which is subjected to different focusing action in accordance with a relation among respective electric potentials of the back electrode 9, the line cathode 7 and the control electrode 8. In view of the above fact, pulse width intensity modulation is used in the first embodiment. When a predetermined potential is applied to each part of the back electrode 9, a plurality of electron beams having the same intensity are emitted from the electron gun. Each aperture of the control electrode 8 has such a shape that the electron beam having passed through the aperture is subjected to different focusing action in two directions which are perpendicular to each other and are perpendicular to the incident direction on the aperture, and the focal length with respect to a focal point where the spread of the electron beam in a horizontal direction parallel to the fluorescent screen becomes minimum, is relatively short. That is, the focal point of the electron beam with respect to the horizontal direction is formed at least once in the deflection region. The above focal point can be shifted in a vertical direction by changing a voltage applied to the control electrode 8 by several to tens of volts. In the first embodiment, in order to strengthen the above focusing action of each aperture of the control electrode 8, protruding portions 81 are provided at both ends of each aperture perpendicular to the fluorescent screen 2 so as to jut into the deflection region. However, it is not always required to provide the protruding portions, but only rectangular or elliptical apertures may be formed in the control electrode.

Figure 4:
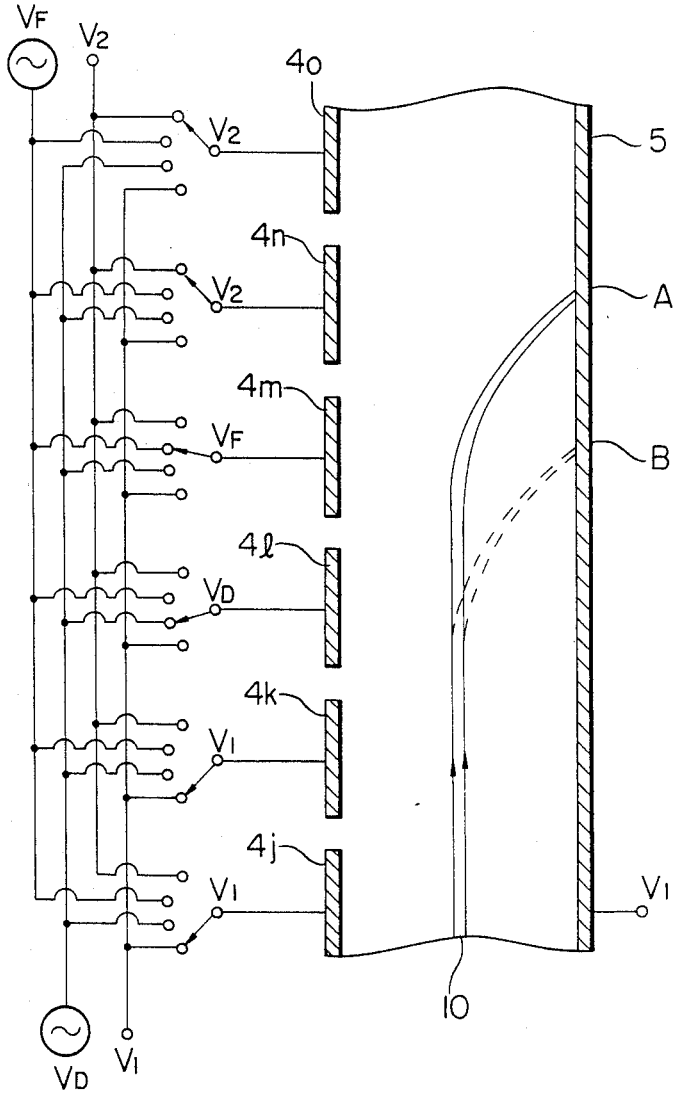
FIG. 4 shows a vertical cross section of part of the embodiment of FIG. 3.

FIG. 4 shows a vertical cross section of part of the deflecting region formed between the deflection plates 4 and the plane electrode 5. Referring to FIG. 4, let us suppose that the deflection plates 4*a*,... 4*j*, 4*k*, 4*l*, 4*m*, 4*n*, 4*o*,... and so on are arranged in this order when viewed from the electron gun side. As shown in FIG. 4, the deflection plates 4*a*,... 4*j* and 4*k* are applied with a first voltage $V_1$ equal to the voltage applied to the plane electrode 5, and the deflection plates 4*n*, 4*m*, and so on are applied to a second voltage $V_2$ lower than the first voltage $V_1$. When a voltage $V_D$ applied to the deflection plate 4*l* is made equal to $V_1$ and a voltage $V_F$ applied to the deflection plate 4*m* is made equal to $V_2$, the electron beam 10 runs straight so as to reach the vicinity of the deflection plate 4*l*, and is then deflected toward the fluorescent screen 2 as a result of the low voltage $V_2$ of the deflection plates 4m, 4n, and so on. In this case, the electron beam 10 passes through a long, narrow aperture of the plane electrode 5 at a point A. When the voltage $V_D$ applied to the deflection plate 4l is changed from $V_1$ to $V_2$ in a state that the voltage $V_F$ applied to the deflection plate 4m is made equal to $V_2$, a position where the electron beam 10 begins to deflect, is moved to the vicinity of the deflection plate 4l, and thus a position where the electron beam 10 passes through the aperture of the plane electrode 5 is moved from the point A to a point B. The moving distance of the above position, that is, the distance between the points A and B is equal to the distance between corresponding points on adjacent deflection plates. When all the deflection plates are successively applied with the voltage $V_D$ for deflecting the electron beam 10 and for causing the electron beam to perform a scanning operation, the whole range in a vertical direction can be scanned with the electron beam.

Figure 5:
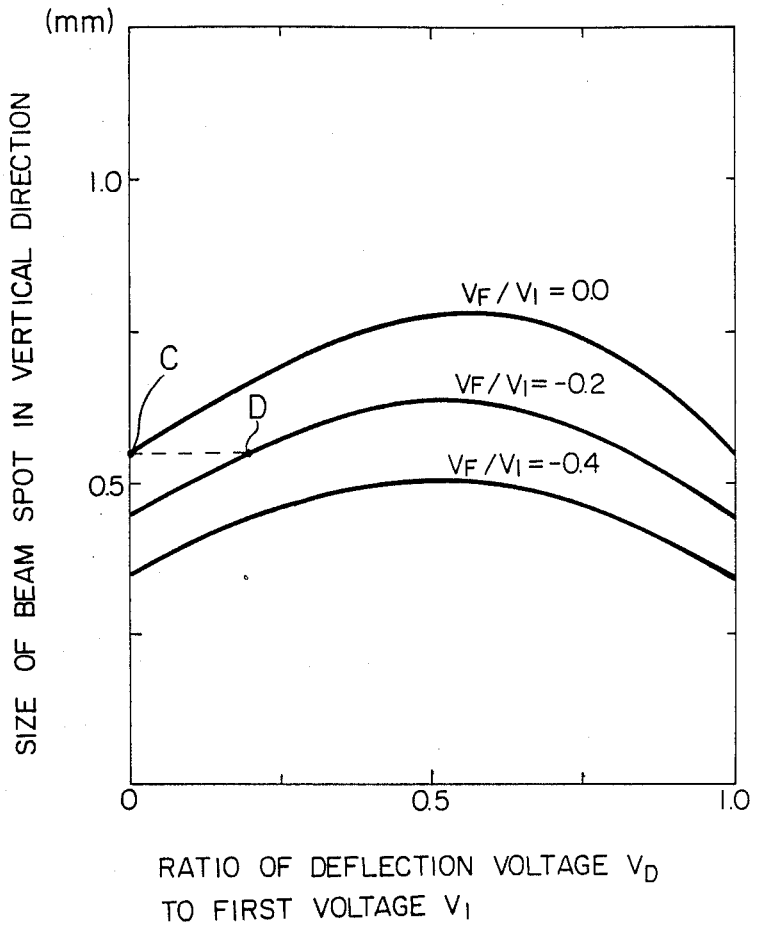
FIG. 5 is a graph showing variations in size of electron beam spot which occur in the embodiment of FIG. 3.

FIG. 5 shows relations between the deflection voltage $V_D$ used in the first embodiment of FIG. 3 and the size of cross section of electron beam at a time the electron beam passes through the plane electrode 5. In more detail, the numbers on the abscissa indicate a ratio of the deflection voltage $V_D$ to the first voltage $V_1$, and the numbers on the ordinate indicate the size of cross section of electron beam in a vertical direction (at a time an electron beam having an initial diameter of 1 mm and having been deflected toward the plane electrode 5 reaches the plane electrode 5. Referring to FIG. 5, when the voltage $V_F$ for correcting the deflecting-/focusing action is kept constant, the size of cross section of electron beam varies with the voltage $V_D$, that is, the cross section of electron beam varies with the scanning operation of the electron beam. Such variations in cross section of electron beam degrades the resolution of an image on the fluorescent screen 2 in a vertical direction, and thus a favorable image is not formed. However, for example, points C and D are equal in size of cross section of electron beam to each other, though the points C and D are different in values of $V_D$ and $V_F$ from each other. Thus, it is possible to keep constant the size of cross section of electron beam in a vertical direction, by combining values of $V_D$ and $V_F$ appropriately. That is, when the voltage $V_F$ is varied in accordance with a change in the deflection $V_D$, the electron beam can perform a scanning operation while keeping constant the size of cross section of electron beam in a vertical direction.

Figure 6A:
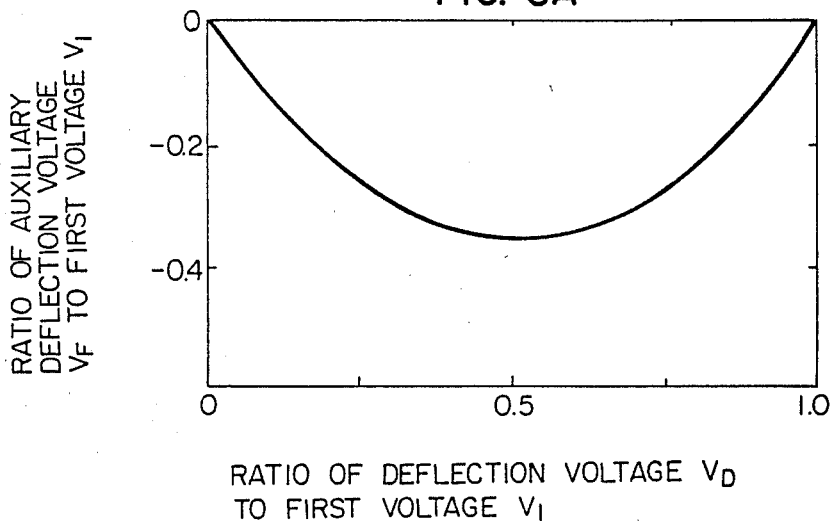
FIG. 6A and 6B are graphs showing a relation between two deflection voltages for keeping the size of electron beam spot constant in the embodiment of FIG. 3.
Figure 6B:
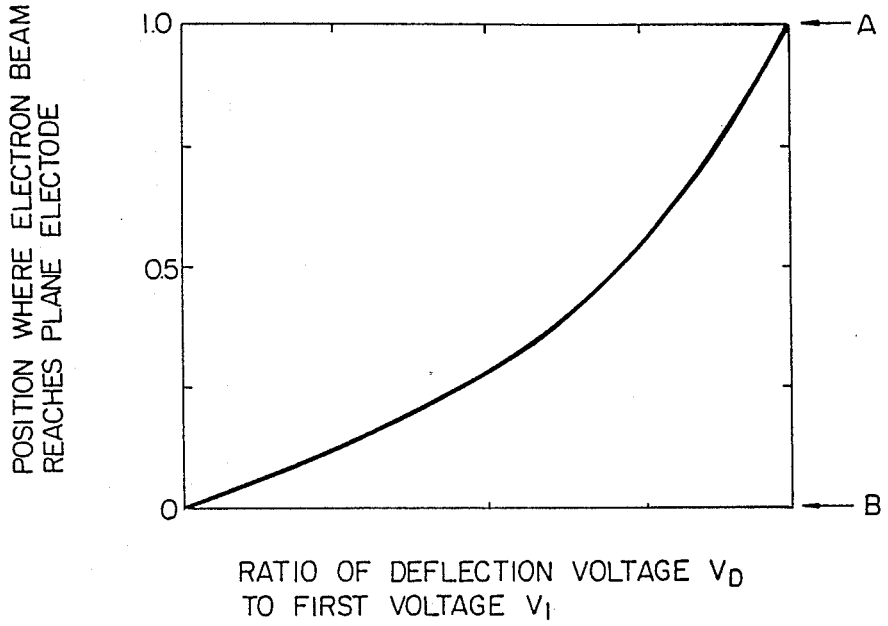

FIG. 6A shows that relation between the voltages $V_D$ and $V_F$ which makes it possible for the electron beam to perform a vertical scanning operation while keeping constant the size of cross section of electron beam in a vertical direction, and FIG. 6B shows a relation between the voltage $V_D$ and a position where the electron beam passes through the plane electrode 5. In FIGS. 6A and 6B, the numbers on the abscissa indicate a ratio of the voltage $V_D$ to the first voltage $V_1$, the numbers on the ordinate of FIG. 6B indicate a scanning distance of electron beam divided by the distance between corresponding portions of adjacent deflection plates 4 to show a position where the electron beam reaches the plane electrode 5, and the numbers on the ordinate of FIG. 6A indicate a ratio of the voltage $V_F$ to the first voltages $V_1$. It is to be noted that the position of electron beam on the plane electrode 5 at a time the voltage $V_D$ is equal to zero, is used as reference position, and the position of electron beam moves upwards when the voltage $V_D$ is increased.

When the voltage $V_D$ is applied to the deflection plate 4l of FIG. 4, the points A and B of FIG. 4 correspond to points A and B shown in FIG. 6B, respectively. As shown in FIG. 6, the scanning distance of electron beam does not vary linearly with the voltage $V_D$. However, when the variation of voltage $V_D$ with time is appropriately adjusted, the scanning speed of electron beam can be made constant.

Figure 7:
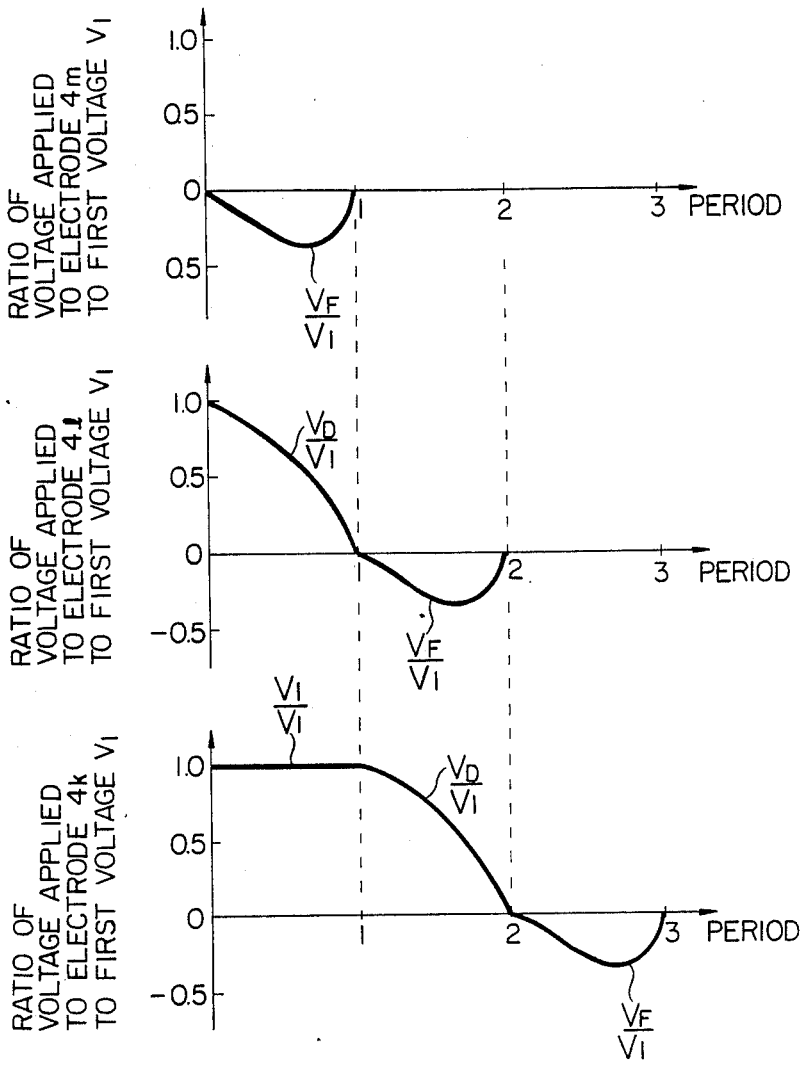
FIG. 7 is a waveform chart showing examples of electrode voltages used in the embodiment of FIG. 3.

FIG. 7 shows waveforms of voltage which are applied to the deflection 4k, 4l and 4m in the first to third periods. Referring to FIG. 7 in the first period, the deflection plates 4m, 4l and 4k are applied with the voltages $V_F$, $V_D$ and $V_l$ respectively, as shown in FIG. 4, in order for the electron beam to perform a scanning operation by a distance equal to the distance between corresponding positions on adjacent deflection plates 4. In the second period, the voltages $V_F$ and $V_D$ are applied to the deflection plates 4l and 4k, respectively, by a changeover operation. At this time, for example, the initial value of the voltage $V_F$ is made equal to the final value of the voltage $V_D$, and thus the waveform of a voltage applied to each deflection plate 4 can be expressed by a continuous curve. When the deflection plates are successively applied with each of the voltages $V_D$ and $V_F$ by the changeover operation, the electron beam can scan the whole region in a vertical direction, while keeping the size of cross section of electron beam constant.

In the first embodiment or FIG. 3, the deflection voltage $V_D$ is changed from the first voltage $V_1$ to the second voltage $V_2$ which is lower than the first voltage $V_1$ and the deflection plates 4 are successively applied with the voltage $V_D$ in a descending order (that is, in a direction from top to bottom). Alternatively, the deflection plates 4 may be successively applied with a different deflection voltage $V_D$ which is changed from the second voltage $V_2$ to the first voltage $V_D$, in an ascending order (that is, in a direction from bottom to top). In this case, however, the electron beam scans the fluorescent screen 2 upwardly in a vertical direction. In the first embodiment, a deflection plate which follows the deflection plate applied with the deflection voltage $V_D$ in the traveling direction of electron beam, is applied with the voltage $V_F$ for correcting the deflecting/focusing action. However, the condition for keeping the size of electron beam spot constant is given only by the combination of values of the voltages $V_D$ and $V_F$. Hence, when the combination of values of the voltages $V_D$ and $V_F$ is varied, the voltages $V_D$ and $V_F$ can exchange their functions. Accordingly, a deflection plate which exists just before the deflection plate applied with the deflection voltage $V_D$ in the traveling direction of electron beam, may be applied with the voltage $V_F$ for correcting the deflecting/focusing action. In this case, also, the electron beam can perform a scanning operation while keeping the size of cross section of electron beam constant.

Figure 8:
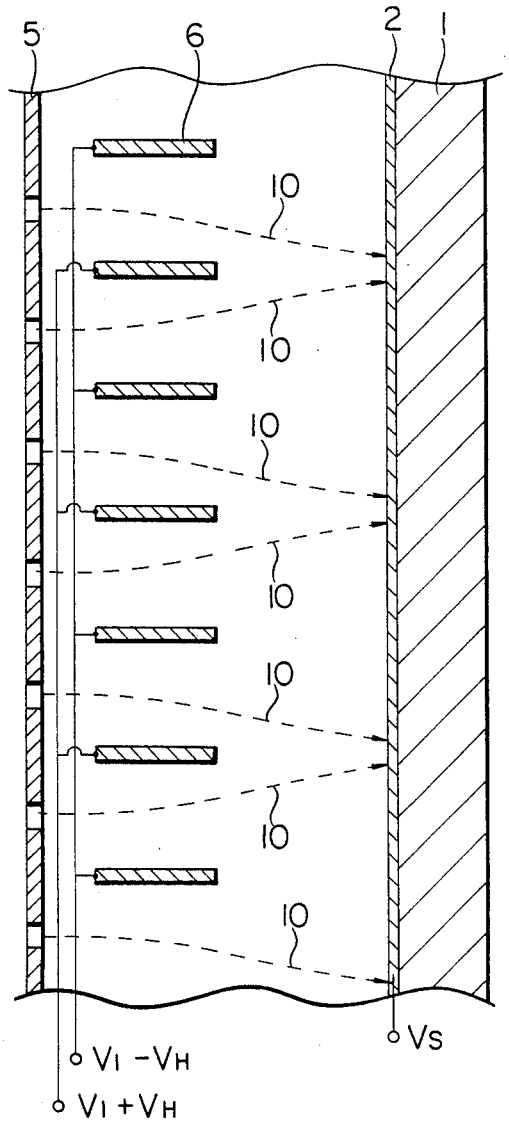
FIG. 8 shows a horizontal cross section of part of the embodiment of FIG. 3.

The electron beams 10 having passed through a long, narrow aperture of the plane electrode 5 is deflected in a horizontal direction by the strip-shaped deflection electrodes 6, and then reaches the fluorescent screen 2. FIG. 8 shows a vertical cross section of part of a region formed between the plane electrode 5 and the face plate 1 of FIG. 3. Referring to FIG. 8, alternate ones of the strip-shaped deflection electrodes 6 are connected to each other, and thus the electrodes 6 are applied with two kinds of voltages, that is, $V_1-V_H$ and $V_1-V_H$ (where $V_H$ is a horizontal deflection voltage which oscillates periodically between a positive peak value and a negative peak value. One strip-shaped deflection electrode 6 contributes to the deflection of two electron beams 10, and hence adjacent electron beams 10 are deflected on a horizontal plane in opposite directions. In a case where such a horizontal scanning method is used in a television receiver, it is required to provide a memory corresponding to at least one horizontal scanning line, but no problem will arise with respect to the circuit configuration of the television receiver. Further, the first voltage $V_1$ and the horizontal deflection voltage $V_H$ are equal to several % of the voltage VS applied to the fluorescent screen 2, and thus a lens having a short focal length for focusing an electron beam 10 in a horizontal direction, is formed between the strip-shaped deflection electrodes 6 and the fluorescent screen 2. Each electron beam 10 is focused in a horizontal direction by the dynamic focusing action of the electron gun before each electron beam is deflected by the strip-shaped deflection electrodes 6, and is again focused by "the above lens". Thus, each electron beam 10 is focused on the fluorescent screen 2 so as to have an optimum spot size on the screen 2. When a correction voltage having a parabolic waveform is added to the horizontal deflection voltage $V_H$, and the voltages thus modified are applied to the electrodes 6, the focusing action of the above lens is corrected in accordance with the amount of deflection, and thus the electron beam can perform a horizontal scanning operation while keeping constant the spot size, even when the electron beam has a large deflection angle.

In the first embodiment, in order to deflect and focus the electron beams 10 in a horizontal direction, the strip-shaped deflection electrodes 6 are arranged independently of each other, and one deflection electrode 6 contributes to the deflection of two adjacent electron beams. Alternatively, a member having a structure that an insulating plate is sandwiched between two deflection electrodes to apply different voltages to the deflection electrodes, may be used in place of each strip-shaped deflection electrode 6. The above member is used in the second conventional device disclosed in the above-referred Japanese Patent Publication JP-A-60-189,849. In this case, alternate ones of the deflection electrodes are electrically connected to each other, and are applied with the voltage $V_1+V_H$ or $V_1-V_H$ (where $V_1$ and $V_H$ indicate the first voltage and the horizontal deflection voltage, respectively). Thus, the electron beams 10 are deflected on a horizontal plane in the same direction.

Next, examples of actual dimensions of the first embodiment shown in FIG. 3 will be described. In a plate-type cathode ray tube having a display screen whose diagonal is about 50 cm, 40 electron beams are disposed at intervals of 10 mm in a horizontal direction, and 19 deflection plates each having a width of 15 mm are disposed so that a gap of 3 mm is formed between adjacent deflection plates 4 and the deflection plates are spaced apart from the plane electrode 5 a distance of 30 mm. Each of the strip-shaped deflection electrodes 6 has a width of 10 mm, and the end of each strip-shaped deflection electrode 6 is spaced apart from the fluorescent screen 2 a distance of 30 mm. As to typical voltages, the first voltage $V_1$ applied to the plane electrode 5 is equal to 500 V, the vertical deflection voltage $V_D$ varies between OV and 500 V, and the horizontal deflection voltage $V_H$ varies between +350V and −350V.

As mentioned above, in the first embodiment of FIG. 3, a desired resolution in a horizontal direction can be obtained by using a small number of electron beams, and hence a control operation for causing the electron beams to perform the same scanning operation is easier, as compared with a similar control operation in a conventional device. Since the number of deflection plates is far smaller than the number of vertical scanning lines and a low deflection voltage is used, the first embodiment is small in power consumption and relatively simple in structure. Each electron beam is focused by the electron gun and the vertical and horizontal deflection members, and thus an optimum spot size can be obtained all over the fluorescent screen 2. Specifically, the first embodiment does not include a beam blocking member such as a shadow mask. Moreover, in the first embodiment, a plurality of electron beams are simultaneously incident on the fluorescent screen at different positions, to emit light from the positions. Thus, the first embodiment has an advantage that each beam current can be made far weaker than the beam current of a conventional color cathode ray tube.

Now, other embodiments of a plate-type cathode ray tube device according to the present invention will be described below.

Figure 9A:
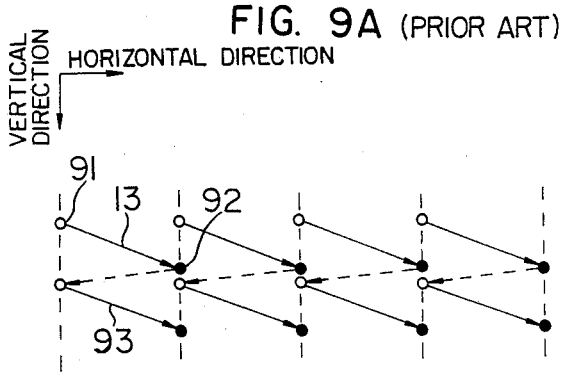
FIG. 9A (PRIOR ART)
FIG. 9A is a schematic diagram showing a scanning operation on the fluorescent screen of a conventional plate-type cathode ray tube device.
Figure 9B:
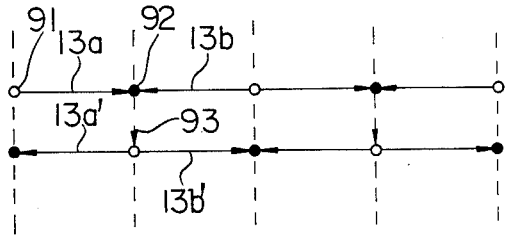
FIG. 9B is a schematic diagram showing a scanning operation on the fluorescent screen of a second embodiment of a plate-type cathode ray tube device according to the present invention.

FIGS. 9A and 9B show the scanning operation on the fluorescent screens of a conventional device and a second embodiment of a plate-type cathode ray tube device according to the present invention. In FIGS. 9A and 9B, a solid line 13 indicates a scanning line, a circle 91 bounded by a heavy border (that is, a white circle) indicates the starting point of one horizontal scanning operation, a black circle 92 indicates the end point of one horizontal scanning operation, and a broken line 93 indicates a fly-back line between the end point 92 of scanning operation and the starting point of the next scanning operation. FIG. 9A shows the scanning operation in a conventional plate-type cathode ray tube device. Referring to FIG. 9A, a plurality of electron beams scan a plurality of display regions each bounded by a pair of dashed lines, in parallel directions. In this conventional device, a horizontal scanning operation and a vertical scanning operation are simultaneously performed, and hence a scanning line 13 is not parallel to a horizontal direction. Thus, it is impossible to display a continuous horizontal scanning line on a fluorescent screen, and the boundary between adjacent display regions is clearly observed. While, FIG. 9B shows the scanning operation in the second embodiment having a structure wherein means for stopping a vertical scanning operation during a horizontal scanning period is added to the first embodiment of FIG. 3. In the second embodiment, adjacent electron beams are deflected on a horizontal plane in opposite directions as shown in FIG. 8, and hence scanning lines **13*a* and 13*b* in adjacent display regions are opposite in direction to each other. Further, the vertical scanning operation is stopped during the horizontal scanning period, and thus a continuous horizontal scanning line is displayed on a fluorescent screen. That is, the drawback of the conventional device can be eliminated. Further, in a case where it is required to display a horizontal line on the fluorescent screen, the horizontal line can be displayed without being distorted. In the second embodiment of FIG. 9B, when one horizontal scanning period terminates, that is, horizontal scanning lines 13*a* and 13*b*** reach the end point 92, a vertical scanning operation is performed in a state that the horizontal scanning operation is stopped. Accordingly, the next horizontal scanning lines 13*a*'and 13*b*'are opposite in direction to the horizontal scanning lines 13*a* and 13*b*, respectively. However, the vertical scanning operation may be performed in a state that a horizontal scanning operation for forming a fly-back line is performed. In this case, the horizontal scanning lines in adjacent display regions can be made equal in direction to each other.

Figure 10:
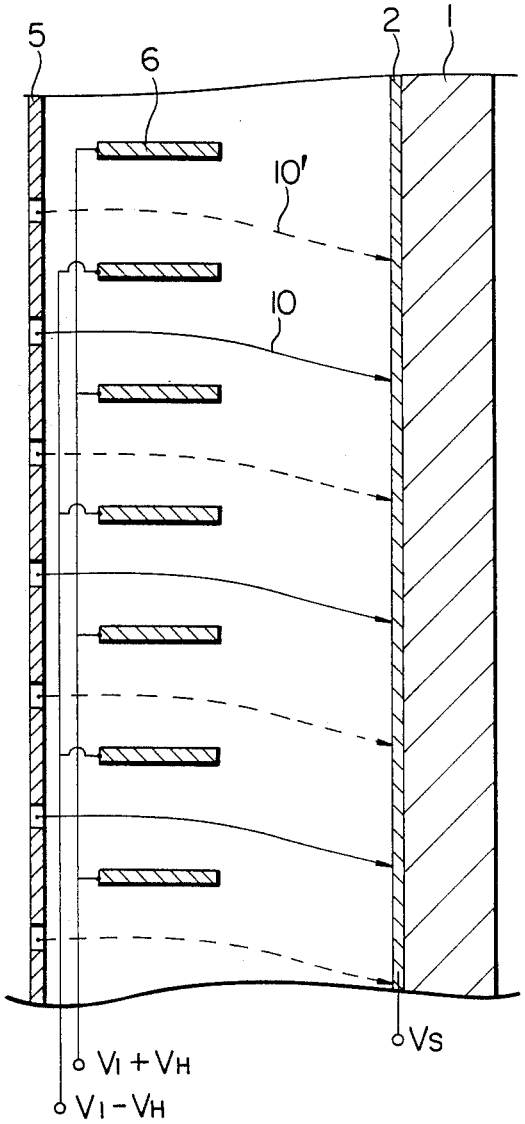
FIG. 10 shows a horizontal cross section of part of a third embodiment of the present invention.

FIG. 10 shows a horizontal cross section of part of a region which is formed between the plane electrode 5 and the face plate 1 of a third embodiment of a platetype cathode ray tube device according to the present invention. Referring to FIG. 10, alternate ones of the strip-shaped deflection electrodes 6 are connected to each other, and thus the strip-shaped deflection electrodes 6 are applied with a voltage $V_1+V_H$ or $V_1-V_H$ (where $V_1$ indicates a first voltage applied to the plane electrode 5, and $V_H$ indicates a horizontal deflection voltage which oscillates periodically between a negative peak value and a positive peak value). The third embodiment includes means for displaying an image due to electron beams 10 each indicated by a solid line and an image due to electron beams 10' each indicated by a broken line, alternately, at an interval of one horizontal scanning period. That is, the image due to the electron beams 10 is displayed during a horizontal scanning period, and the image due to the electron beams 10' is displayed during the next horizontal scanning period. In two consecutive horizontal scanning periods, a voltage applied to each strip-shaped deflection electrode 6 is reversed in polarity. Accordingly, the images due to the electron beams 10 and 10' which are deflected in the same direction, are displayed. Further, the vertical scanning operation is stopped for two consecutive horizontal scanning periods, and thus a straight scanning line can be displayed on the fluorescent screen 2. That is, in the third embodiment of FIG. 10, the fluorescent screen can be horizontally scanned with electron beams in a predetermined direction.

Figure 11:
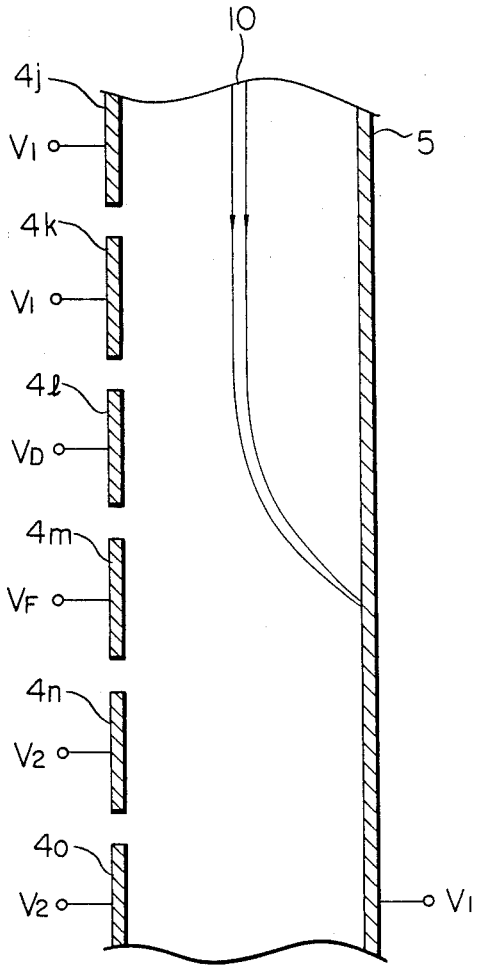
FIG. 11 shows a vertical cross section of part of a fourth embodiment of the present invention.

FIG. 11 shows a vertical cross section of part of a region which is formed between the deflection plates 4 and the plane electrode 5 of a fourth embodiment of a plate-type cathode ray tube device according to the present invention. The fourth embodiment is different from the first embodiment of FIG. 3 in that an electron gun for emitting a plurality of electron beams is provided at the top of a deflection region in a vertical direction. Accordingly, each electron beam 10 goes downwardly into the deflection region. Now, let us consider the following case. The deflection plates 4*k*, 4*j* and so on which exists near the electron gun, are applied with the first voltage $V_1$ equal to the voltage applied to the plane electrode 5, the deflection plates 4*n*, 4*o* and so on are applied with the second voltage $V_2$ which is lower than the first voltage $V_1$, the deflection plate 4*l* is applied with the deflection voltage $V_D$ which varies from $V_2$ to $V_1$, and the deflection plate 4*m* is applied with the voltage $V_F$ for correcting the deflecting/focusing action. In this case, a position where an electron beam reaches the plane electrode 5, is shifted downwardly in a vertical direction, in a state that the size of cross section of electron beam in a vertical direction is kept constant. Accordingly, when the deflection plates 4 are successively applied with each of the voltage $V_D$ and $V_F$ downwardly by a changeover operation, the whole range of the fluorescent screen 2 in a vertical direction can be scanned with the electron beam.

Figure 12:
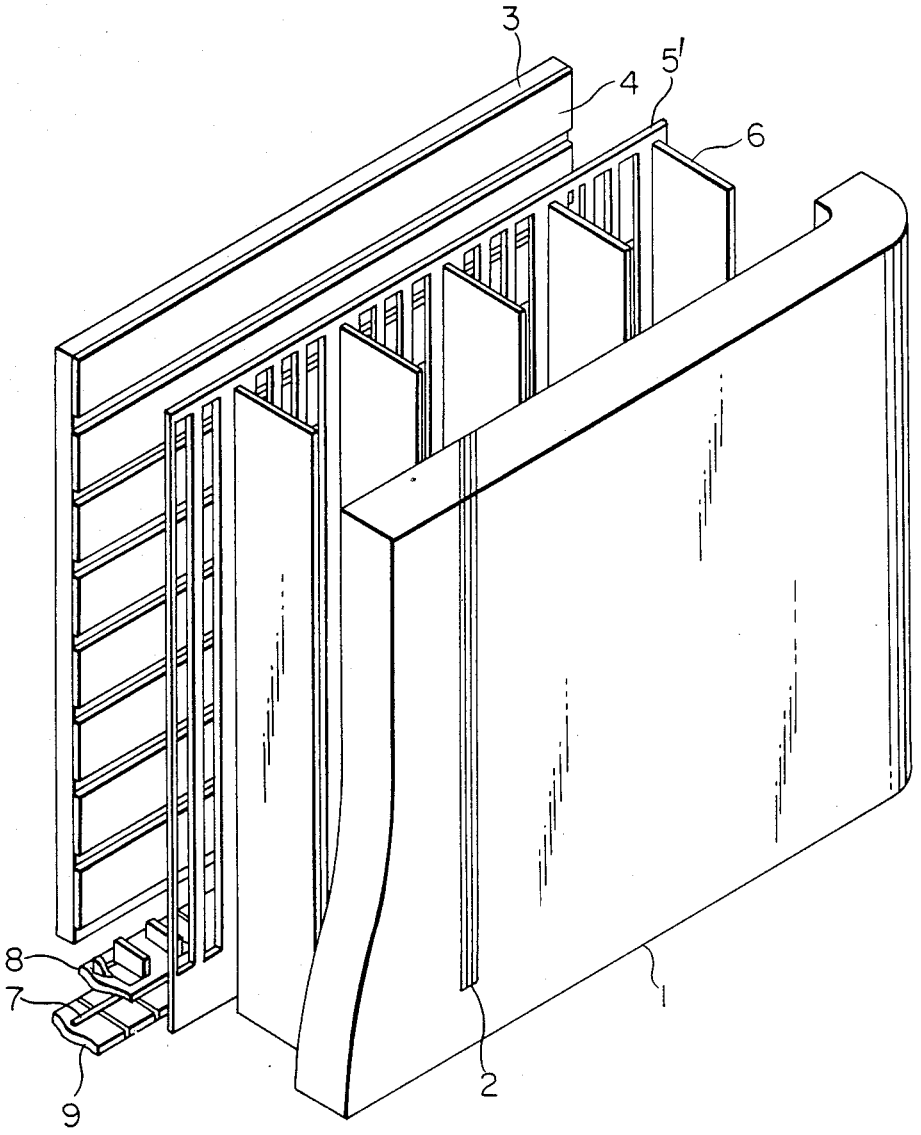
FIG. 12 is a partially cutaway view in perspective of a fifth embodiment of the present invention.

FIG. 12 is a partially cutaway view in perspective of a fifth embodiment of a plate-type cathode ray tube device according to the present invention. Referring to FIG. 12, a fluorescent screen 2, deflection plates 4, a plane electrode 5', strip-shaped deflection electrodes 6, a line cathode 7, a control electrode 8 and a back electrode 9 are disposed within a vacuum vessel which is made of glass and includes a face plate 1 and a back panel 3. The fifth embodiment of FIG. 12 is different from the first embodiment of FIG. 3 in the positional relation between the long, narrow apertures of the plane electrode 5 or 5' and the strip-shaped deflection electrodes 6. That is, in the fifth embodiment of FIG. 12, three electron beams having passed through three adjacent apertures of the plane electrode 5' pass through a region formed between a pair of strip-shaped deflection electrodes 6, to be deflected in a horizontal direction. When the three electron beams performs a horizontal scanning operation, each of three electron beams selectively impinges on a corresponding one of fluorescent materials corresponding to three primary colors, to emit desired light from the fluorescent material. Now, let us consider a case where the fifth embodiment of FIG. 12 is equal in the number of fluorescent stripes which are formed in a deflection region bounded by a pair of strip-shaped deflection electrodes 6, to the first embodiment of FIG. 3. In the fifth embodiment of FIG. 12, the fluorescent materials corresponding to the three primary colors are simultaneously bombarded with the electron beams, and hence the mean beam current of one electron beam for obtaining predetermined luminance is one-third the mean beam current in the first embodiment of FIG. 3. Hence, the focusing characteristic of electron beam is improved, and the picture quality of displayed image and the chromatic purity can be improved. Further, a horizontal deflection voltage changeover time necessary for selecting one of different fluorescent stripes is three times longer than that in the first embodiment of FIG. 3, and hence it is easy to drive the horizontal deflection voltage, and a desired fluorescent stripe can be accurately bombarded with the electron beam. Further, let us consider a case where the fifth embodiment of FIG. 12 is equal in the number of electron beams to the first embodiment of FIG. 3. In the fifth embodiment of FIG. 12, three electron beams are deflected between a pair of strip-shaped deflection electrodes 6, and hence the number of strip-shaped deflection electrodes 6 is about one-third the number of deflection electrodes 6 used in the first embodiment of FIG. 3. The fifth embodiment of FIG. 12 is substantially equal in structure and operation to the first embodiment of FIG. 3, excepting the above-mentioned points. Hence, in the fifth embodiment of FIG. 12, each electron beam can form an optimum beam spot at the whole area of a fluorescent screen, as in the first embodiment of FIG. 3.

Figure 13:
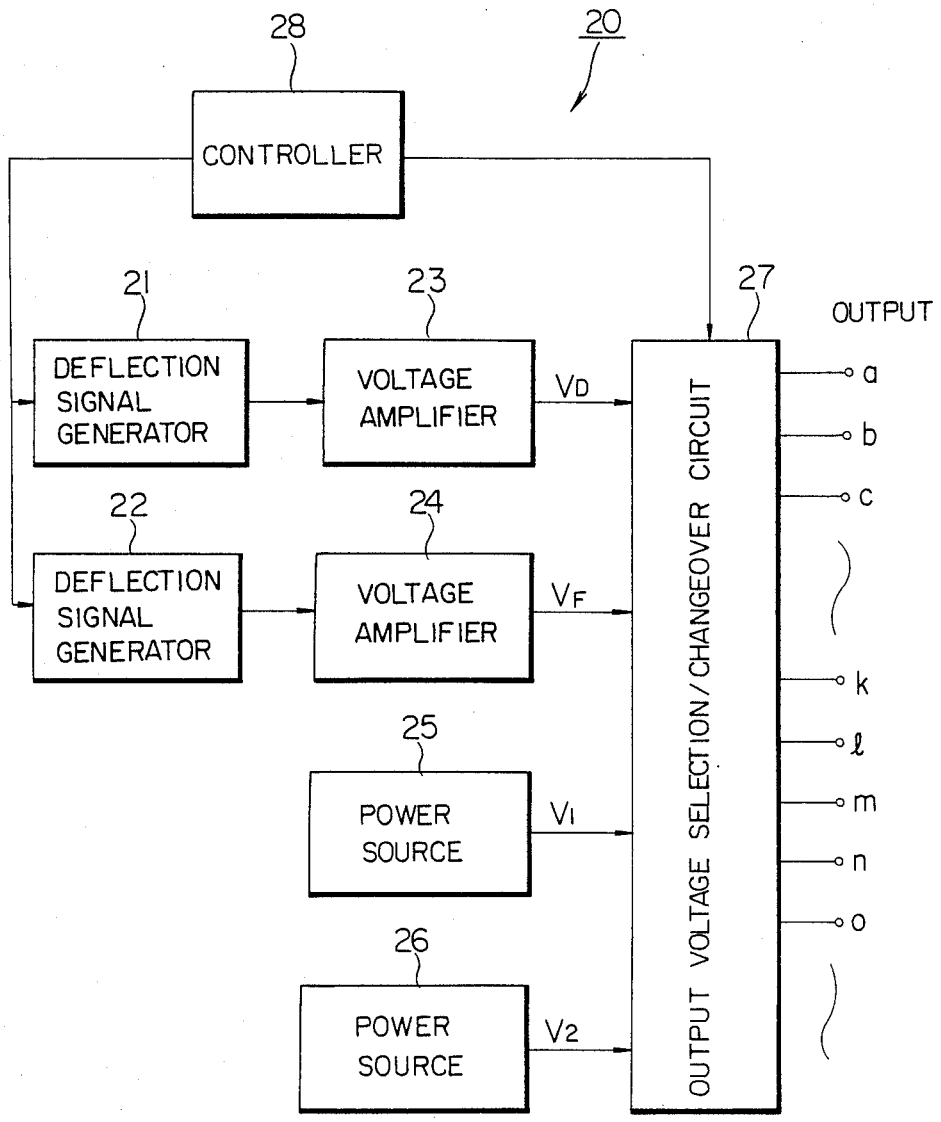
FIG. 13 is a block diagram showing the circuit configuration of an example of voltage generating means used in a plate-type cathode ray tube device according to the present invention.

FIG. 13 is a block diagram showing an example of a voltage generating unit which is used in a plate-type cathode ray tube device according to the present invention. Referring to FIG. 13, a voltage generating unit 20 includes deflection signal generators 21 and 22, voltage amplifiers 23 and 24, power sources 25 and 26, an output voltage selection/changeover circuit 27, and a controller 28 for controlling the circuits 21. 22 and 27. The deflection signal generators 21 and 22 generate predetermined deflection signals in response to a trigger pulse from the controller 28. The deflection voltages thus generated are amplified by the voltage amplifiers 23 and to form variable voltages $V_D$ and $V_F$ which can deflect an electron beam and can cause the electron beam to perform a scanning operation in a predetermined direction while keeping constant the focusing action in the predetermined direction. The output voltage selection/changeover circuit 27 is applied with not only the variable voltages $V_D$ and $V_F$ but also constant voltages $V_1$ and $V_2$ from the power sources 25 and 26, and each of the output voltages a, b, c, ...k, (, m, n, o, ... and so on from the circuit 27 is given by any one of the voltage $V_D$, $V_H$, $V_1$ and $V_2$. The output voltages a, b, c, ... and so on are applied to the deflection plates 4a, 4b, 4c, ... and so on, respectively, and the voltages $V_D$ and $V_F$ are applied to at least two adjacent deflection plates with the aid of the output voltage selection/changeover circuit 27.

Figure 14:
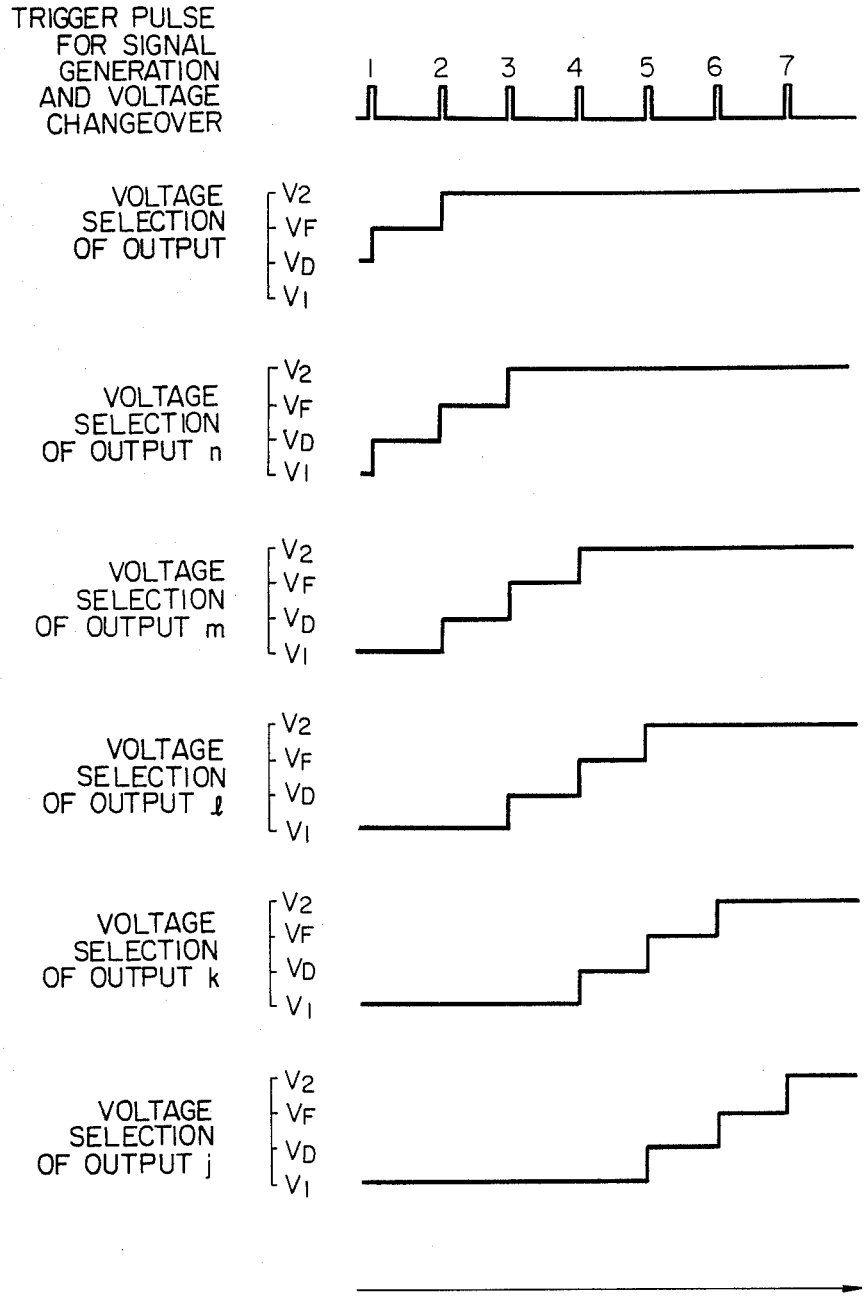
FIG. 14 is a waveform chart showing relations between trigger pulses sent out from the controller of FIG. 13 and output voltages of the output voltage selection/changeover circuit of FIG. 13.

FIG. 14 is a schematic diagram showing the operations of the controller 28 and the output voltage selection/changeover circuit 27. In a case where a picture image is displayed on a fluorescent screen with the aid of the voltage generating unit 20 of FIG. 13, the voltages $V_D$ and $V_F$ for deflecting and focusing electron beams start from, for example, deflection plates for scanning an upper portion of the fluorescent screen with the electron beams, and all deflection plates are successively applied with each of the voltages $V_D$ and $V_F$ in synchronizm with trigger pulses for signal generation and voltage changeover which are generated by the controller 28. Referring to FIG. 14, let us suppose that the deflection plate 4o applied with the output voltage o and the deflection plate 4n applied with the output voltage n are deflection plates for scanning the upper portion of the fluorescent screen with the electron beams. In a period between first and second trigger pulses, the output voltage n is kept at the deflection voltage $V_D$ for deflecting the electron beams and the output voltage o is kept at the voltage $V_F$ for correcting the focusing action on the electron beams. Other output voltages are all kept at the voltage $V_1$ for causing the electron beams to run straight. When the second trigger pulse is generated, the output voltage o is changed from $V_F$ to $V_2$, and the output voltage n is changed from $V_D$ to $V_F$. Further, the output voltage m is changed from $V_1$ to $V_D$, and thus the deflection plate 4m serves as the deflection plate for scanning the fluorescent screen with the electron beams. When the trigger pulses successively generated, all deflection plates are successively with applied with each of the voltages $V_D$ and $V_F$, and thus a scanning operation proceeds. When scanning lines reach the bottom of the fluorescent screen, the controller 28 generates a repetition signal, to repeat the above scanning operation.

Figure 15:
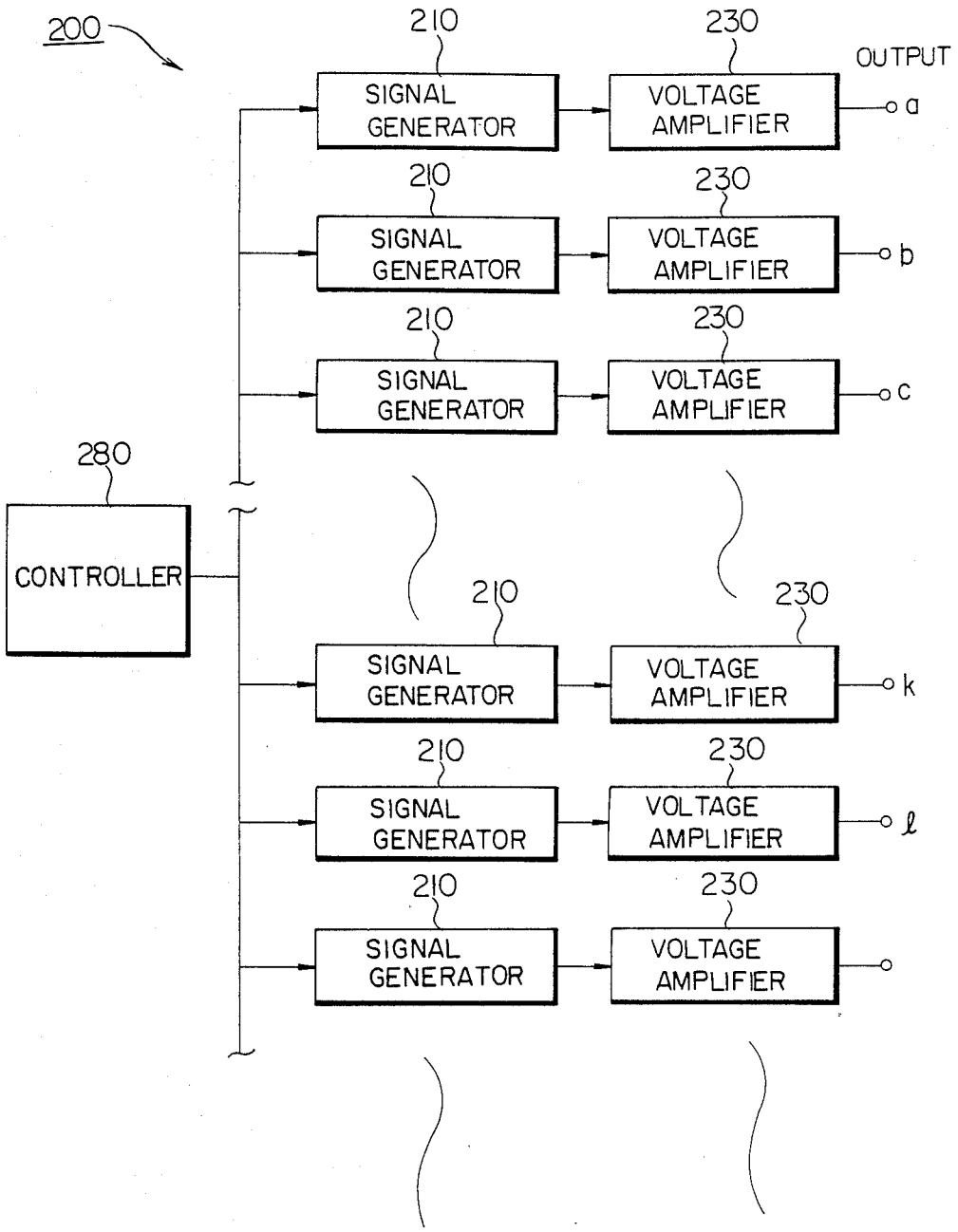
FIG. 15 is a block diagram showing the circuit configuration of another example of voltage generating means used in a plate-type cathode ray tube device according to the present invention.
Figure 16:
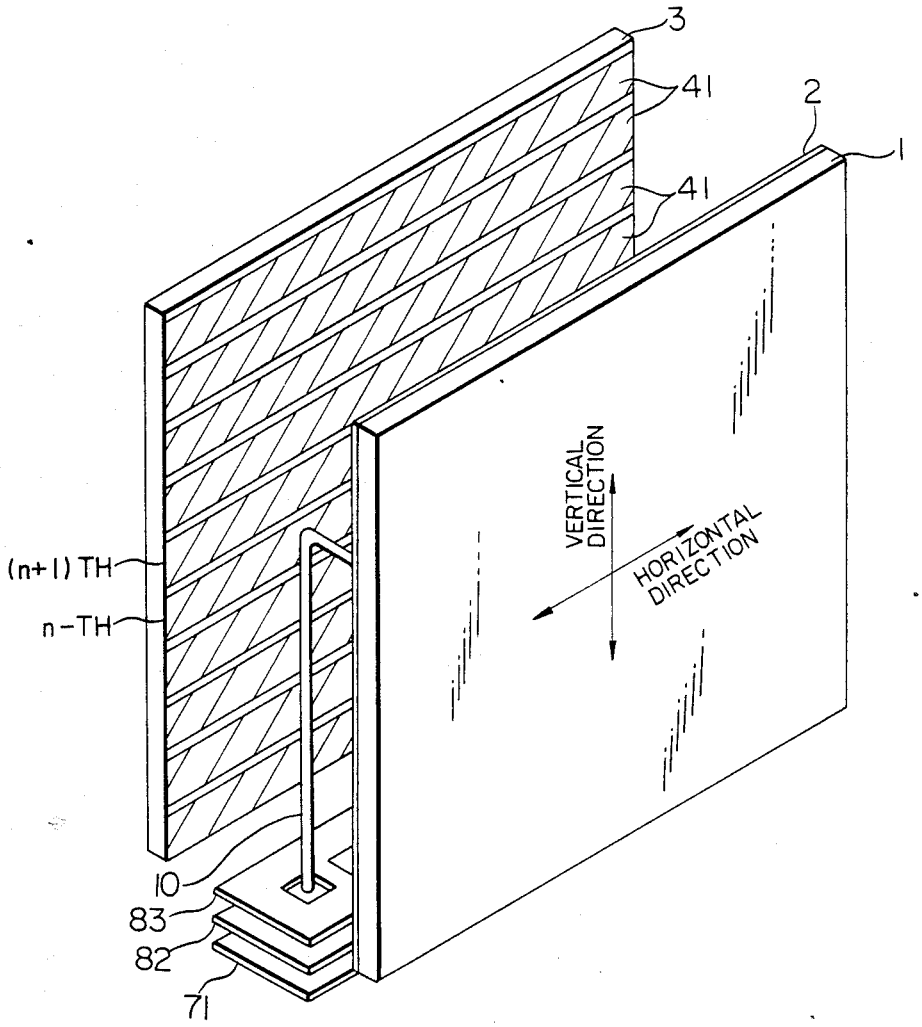
FIG. 16 PRIOR ART
FIG. 16 is a perspective view showing a main part of a conventional plate-type cathode ray tube device.
Figure 17:
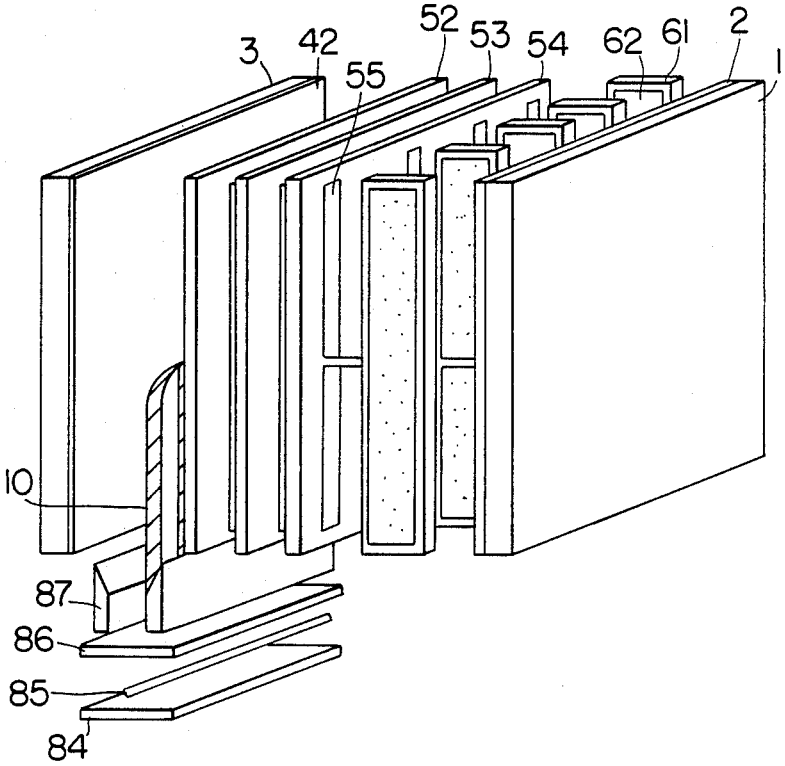
FIG. 17 PRIOR ART
FIG. 17 is a perspective view showing a main part of another conventional plate-type cathode ray tube device.

FIG. 15 is a block diagram showing another example of a voltage generating unit which is used in a plate-type cathode ray tube device according to the present invention. Referring to FIG. 15, a voltage generating unit 200 includes signal generators 210 and voltage amplifiers 230 which correspond to the output voltages a, b, c, ... k, l, and so on, and these output voltages are controlled by a controller 280. The voltage generating unit 200 can dispense with changeover means such as the output voltage selection/ changeover circuit 27 of FIG. 13.

Alternatively, the voltage generating unit 200 of FIG. 15 may be combined with the voltage generating unit 20 of FIG. 13. That is, signals from two signal generators 210 are applied to an output voltage selection/changeover circuit 27 to obtain a plurality of output voltages, and the output voltages thus obtained are amplified by voltage amplifiers 230, to be applied to the deflection plates 4.

We claim:

1. A plate-type cathode ray tube device comprising:

a fluorescent screen;

electron beam emitting means for emitting a plurality of electron beams in directions parallel to the fluorescent screen;

first deflection means provided so that the electron beams are arranged between the first deflection means and the fluorescent screen, for causing the electron beams to perform a scanning operation in directions parallel to directions in which the electron beams are emitted, and for deflecting the electron beams towards the fluorescent screen, the first deflection means being made up of a plurality of long, narrow deflection plates juxtaposed in a direction "parallel" to the directions, in which the electron beams are emitted; and voltage generating means for applying voltages simultaneously to at least two adjacent deflection plates for keeping constant the focusing action on said electron beam in a scanning direction, when the electron beams are deflected and perform a scanning operation.

2. A plate-type cathode ray tube device according to claim 1, wherein the voltage generating means applies a variable voltage which is changed from a voltage $V_1$ for causing each electron beam to run straight, to a predetermined voltage $V_3$, to that one of the two adjacent deflection plates which is nearer to the electron beam emitting means, and applies a variable voltage which is changed from the predetermined voltage $V_3$ to a voltage $V_2$ lower than the voltage $V_1$, to that one of the two adjacent deflection plates which is far away from the electron beam emitting means.

3. A plate-type cathode ray tube device according to claim 1, wherein the voltage generating means applies a variable voltage which is changed from a predetermined voltage $V_3$ to a voltage $V_1$ for causing each electron beam to run straight, to that one of the two adjacent deflection plates which is nearer to the electron beam emitting means, and applies a variable voltage which is changed from a voltage $V_2$ lower than the voltage $V_1$ to the predetermined voltage $V_3$, to that one of the two adjacent deflection plates which is far away from the electron beam emitting means.

4. A plate-type cathode ray tube device according to claim 1, further comprising second deflection means means disposed between the electron beams and the fluorescent screen for deflecting the electron beams in a direction substantially perpendicular to the directions, in which the electron beams are emitted, and for focusing each electron beam in said directing the second deflection means being made up of a plurality of long, narrow strip-shaped deflection electrodes each extended in a direction parallel to the directions, in which the electron beams are emitted, at least one electron beam being disposed between a pair of strip-shaped deflection electrodes.

5. A plate-type cathode ray tube device according to claim 4, wherein a scanning operation due to one of the first and second deflection means is stopped during a period when the other deflection means causes the electron beams to perform a scanning operation.

6. A plate-type cathode ray tube device according to claim 4, wherein in two consecutive scanning periods due to the second deflection means, odd-numbered ones and even-numbered ones of a plurality of scanning regions separated by the strip-shaped deflection electrodes are alternately scanned with the electron beams.

7. A plate-type cathode ray tube device comprising:

a face plate provided with a fluorescent screen, a fluorescent material being applied to the fluorescent screen in a predetermined direction;

a back pane provided with a plurality of first deflection electrodes, the first deflection electrodes being parallel to the fluorescent screen, the first deflection electrodes being disposed at regular intervals in the predetermined direction, each of the first deflection plates extending in a direction perpendicular to or parallel with the predetermined direction;

a second deflection electrode disposed in parallel with the first deflection electrodes and having a plurality of apertures, the apertures being formed at regular intervals in a direction perpendicular to the predetermined direction, each of the apertures extending in a direction parallel to the predetermined direction;

a plurality of third deflection electrodes disposed between the fluorescent screen and the second deflection electrode so that each of the third deflection electrodes is perpendicular to the second deflection electrode and the apertures of the second deflection electrode are isolated from each other by the third deflection electrodes, alternate ones of the third deflection electrodes being electrically connected to each other;

an electron gun disposed at one end of the apertures of a deflection space formed between the first deflection electrodes and the second deflection electrode which corresponds to one end portions of the apertures of the second deflection electrode, for emitting a plurality of electron beams in directions parallel to the fluorescent screen, the number of electron beams corresponding to the number of apertures of the second deflection electrode; and voltage generating means for applying at least two adjacent ones of the first deflection electrodes simultaneously with a vertical deflection voltage for deflecting the electron beams so as to make the electron beams perpendicular to the fluorescent screen and a focusing correction voltage for correcting the focusing action on the electron beams, and for applying the third deflection electrodes with a horizontal deflection voltage for deflecting the electron beams on the fluorescent screen in a horizontal direction.

8. A plate-type cathode ray tube device according to claim 7, wherein a first to (n−1)th ones of the first deflection electrodes are successively applied with the vertical deflection voltage by means of the voltage generating means.

9. A plate-type cathode ray tube device according to claim 7, wherein a second to n-th ones of the first deflection electrodes are successively applied with the focusing correction voltage by means of the voltage generating means.

10. A plate-type cathode ray tube device according to claim 7, wherein not only the second deflection electrode but also a first deflection electrode of at least two adjacent ones of the first deflection electrodes applied with the vertical deflection voltage, are applied with a first constant voltage by means of the voltage generating means.

11. A plate-type cathode ray tube device according to claim 10, wherein that one of the first deflection electrodes which exists just behind the first deflection electrode applied with the focusing correction voltage, to an n-th one of the first deflection electrodes, are applied with a second constant voltage lower than the first constant voltage by means of the voltage generating means.

12. A plate-type cathode ray tube device according to claim 7, wherein the electron gun is disposed at the other end of the deflection space.

13. A plate-type cathode ray tube device according to claim 12, wherein a second to n-th ones of the first deflection electrodes are successively applied with the vertical deflection voltage by means of the voltage generating means.

14. A plate-type cathode ray tube device according to claim 12, wherein a first to (n-l)th ones of the first deflection electrodes are successively applied with the focusing correction voltage by means of the voltage generating means.

15. A plate-type cathode ray tube device according to claim 12, wherein not only the second deflection electrode but also an n-th one of the first deflection electrodes to that one of the first deflection electrodes which exists just before a first deflection electrode of the at least two adjacent ones of the first deflection electrodes applied with the vertical deflection voltage, are applied with a first constant voltage by means of the voltage generating means.

16. A plate-type cathode ray tube device according to claim 15, wherein that one of the first deflection electrodes which exists just behind the first deflection electrode applied with the focusing correction voltage, to the first one of the first deflection electrodes are applied with a second control voltage lower than the first constant voltage by means of the voltage generating means.

17. A plate-type cathode ray tube device according to claim 7, wherein the voltage generating means applies the third deflection electrodes with the horizontal deflection voltage for making the horizontal scanning operations of each electron beam in two consecutive scanning sections opposite in direction to each other.

18. A plate-type cathode ray tube device according to claim 7, wherein the voltage generating means applies the third deflection electrodes with the horizontal deflection voltage for making the horizontal scanning operations of each electron beam in two consecutive scanning sections equal in direction to each other.

* * * * *